US005374982A

United States Patent [19]

Boockkholdt

[11] Patent Number: 5,374,982

[45] Date of Patent: Dec. 20, 1994

[54] MECHANISM FOR CONTROLLING ROLLER CONTACT IN A LIQUID ELECTROPHOTOGRAPHY SYSTEM

[75] Inventor: Darius Boockkholdt, Meridian, Id.

[73] Assignee: Hewlett-Packard Company, Palo Alto, Calif.

[21] Appl. No.: 180,589

[22] Filed: Jan. 12, 1994

[51] Int. Cl.[5] ..... G03G 15/16

[52] U.S. Cl. ..... 355/277; 355/271

[58] Field of Search ..... 355/271, 273, 274, 277, 355/275, 279; 430/126

[56] References Cited

U.S. PATENT DOCUMENTS

| | | | |
|---|---|---|---|
| 4,015,027 | 3/1977 | Buchan . | |
| 4,187,774 | 2/1980 | Iwasa et al. | 355/271 |
| 4,430,412 | 2/1984 | Miwa et al. | 430/126 |
| 4,541,709 | 9/1985 | Kampschreur | 355/271 |
| 4,684,238 | 8/1987 | Till et al. | 355/10 |
| 4,796,048 | 1/1989 | Bean | 355/3 |
| 4,931,839 | 6/1990 | Tompkins et al. | 355/277 |
| 4,974,027 | 10/1990 | Landa et al. | 355/256 |
| 4,984,025 | 1/1991 | Landa et al. | 355/274 |
| 5,084,735 | 1/1992 | Rimai et al. | 355/271 |
| 5,099,286 | 3/1992 | Nishise et al. | 355/271 X |
| 5,119,140 | 6/1992 | Berkes et al. | 355/271 X |
| 5,196,893 | 3/1993 | Nishise et al. | 355/271 |
| 5,237,374 | 8/1993 | Ueno et al. | 355/299 |
| 5,243,392 | 9/1993 | Berkes et al. | 355/275 |
| 5,268,687 | 12/1993 | Peled et al. | 346/108 |
| 5,276,492 | 1/1994 | Landa et al. | 355/277 |
| 5,285,244 | 2/1994 | Bujese | 355/326 R |
| 5,291,251 | 3/1994 | Storlie et al. | 355/271 |
| 5,291,252 | 3/1994 | Kawaishi | 355/272 |
| 5,291,254 | 3/1994 | Shimada et al. | 355/271 X |

*Primary Examiner*—R. L. Moses

[57] ABSTRACT

An imaging apparatus transfers toned images to sheets from a photoconductor surface and comprises: a movable photoconductor surface; a transfer roller positioned between support struts; a pressure roller positioned between support struts; a first spring system for biasing the transfer roller against the pressure roller; a second spring system connected to the transfer roller support struts; and a movable actuation mechanism coupled to the pressure roller support struts. The movable actuation system is engageable with the second spring system and first biases the transfer roller against the movable photoconductive surface. Additional movement of the actuation system enables the first spring system to remove the transfer roller from contact with the moveable photoconductor surface and to move the pressure roller from contact with the transfer roller, such movements out of contact occurring in sequence.

10 Claims, 6 Drawing Sheets

MECHANISM FOR CONTROLLING ROLLER CONTACT IN A LIQUID ELECTROPHOTOGRAPHY SYSTEM

FIELD OF THE INVENTION

This invention relates to liquid electrophotography systems which employ an intermediate transfer roller and, more particularly, to a liquid electrophotography system that incorporates a mechanism for assuring both proper contact and proper separation between pressure, transfer and photoconductor rollers.

BACKGROUND OF THE INVENTION

In FIG. 1, there is illustrated a schematic of a prior art, four color liquid electrophotography system. A pair of rollers 10 and 12 support and move an organic photoconductor (OPC) belt 14. A laser beam 16 image-wise exposes OPC belt 14 as it passes around roller 12. Exposed areas of OPC belt 14 are then passed through developer modules 18. In the known manner, OPC belt 14 requires four passes through developer modules 18 so as to achieve a superimposition of four color planes which comprise the color image (i.e. cyan, magenta, yellow and black). Until all four passes are accomplished, a transfer roller 20 is maintained out of contact with OPC roller 12. However, after the final pass of OPC belt 14 through developer modules 18, transfer roller 20 is brought into contact with OPC belt 14 so as to enable a transfer of the image from OPC belt 14 to the surface of transfer roller 20. A sheet of paper 22 is then passed between transfer roller 20 and a heated pressure roller 24 to allow transfer of the image from transfer roller 20 to paper sheet 22.

Subsequent to transfer of the image from OPC belt 14 to transfer roller 20 and thence to paper 22, a fifth pass occurs to enable OPC belt 14 to be cleaned of residual toner. It has been found that some toner collects just past the image area during the toning process. Such toner is not removed until the fifth cleaning pass. If such residual toner is allowed to contaminate transfer roller 20, it can be later transferred to paper sheet 22 and ruin any image thereon. While transfer roller 20 may be controlled to separate from OPC roller 12 and OPC belt 14 at the end of the image (thus avoiding contact with residual toner following the image), because a substantial portion of the image still resides on transfer roller 20 that has not yet been emplaced on paper sheet 22, the pressure between transfer roller 20 and pressure roller 24 must still be maintained unchanged until the image transfer function is complete.

During a print operation, the temperature and pressure at the point of contact between OPC roller 12 and transfer roller 20 are maintained at approximately 50° C. and at a pressure of approximately 50 pounds. These conditions assure appropriate transfer of the toner from OPC belt 14 to transfer roller 20.

By contrast, pressure roller 24 is heated to maintain its point of contact with transfer roller 20 (and paper sheet 22) at between 100°–150° C. at a pressure of approximately 200 pounds. If transfer roller 20 and pressure roller 24 are maintained in contact when no printing action is in process, the elevated temperature of pressure roller 24 can cause the temperature of transfer roller 20 to elevate to an unacceptable level. Thus, when no printing action is in process, pressure roller 24 should be separated from transfer roller 20 to assure relative temperature isolation therebetween (and also to avoid creation of a pressure set in the transfer roller).

Accordingly, it is an object of this invention to provide an improved system for the control of roller contact in a liquid electrophotography system.

It is an other object of this invention to provide a liquid electrophotography system with an improved roller positioning system that requires only a single actuation mechanism.

It is a further object of this invention to provide electrophotography system with an improved roller contact control mechanism wherein contamination of a transfer roller by residual color toner is avoided.

It is yet another object of this invention to provide an improved mechanism for control of roller positioning in a liquid electrophotography system wherein substantial temperature isolation between rollers is assured.

SUMMARY OF THE INVENTION

An imaging apparatus transfers toned images to sheets from a photoconductor surface and comprises: a movable photoconductor surface; a transfer roller positioned between support struts; a pressure roller positioned between support struts; a first spring system for biasing the transfer roller against the pressure roller; a second spring system connected to the transfer roller support struts; and a movable actuation mechanism coupled to the pressure roller support struts. The movable actuation system is engageable with the second spring system and first biases the transfer roller against the movable photoconductive surface. Additional movement of the actuation system enables the first spring system to remove the transfer roller from contact with the moveable photoconductor surface and to move the pressure roller from contact with the transfer roller, such movements out of contact occurring in sequence.

DETAILED DESCRIPTION OF THE INVENTION

Figure 1:
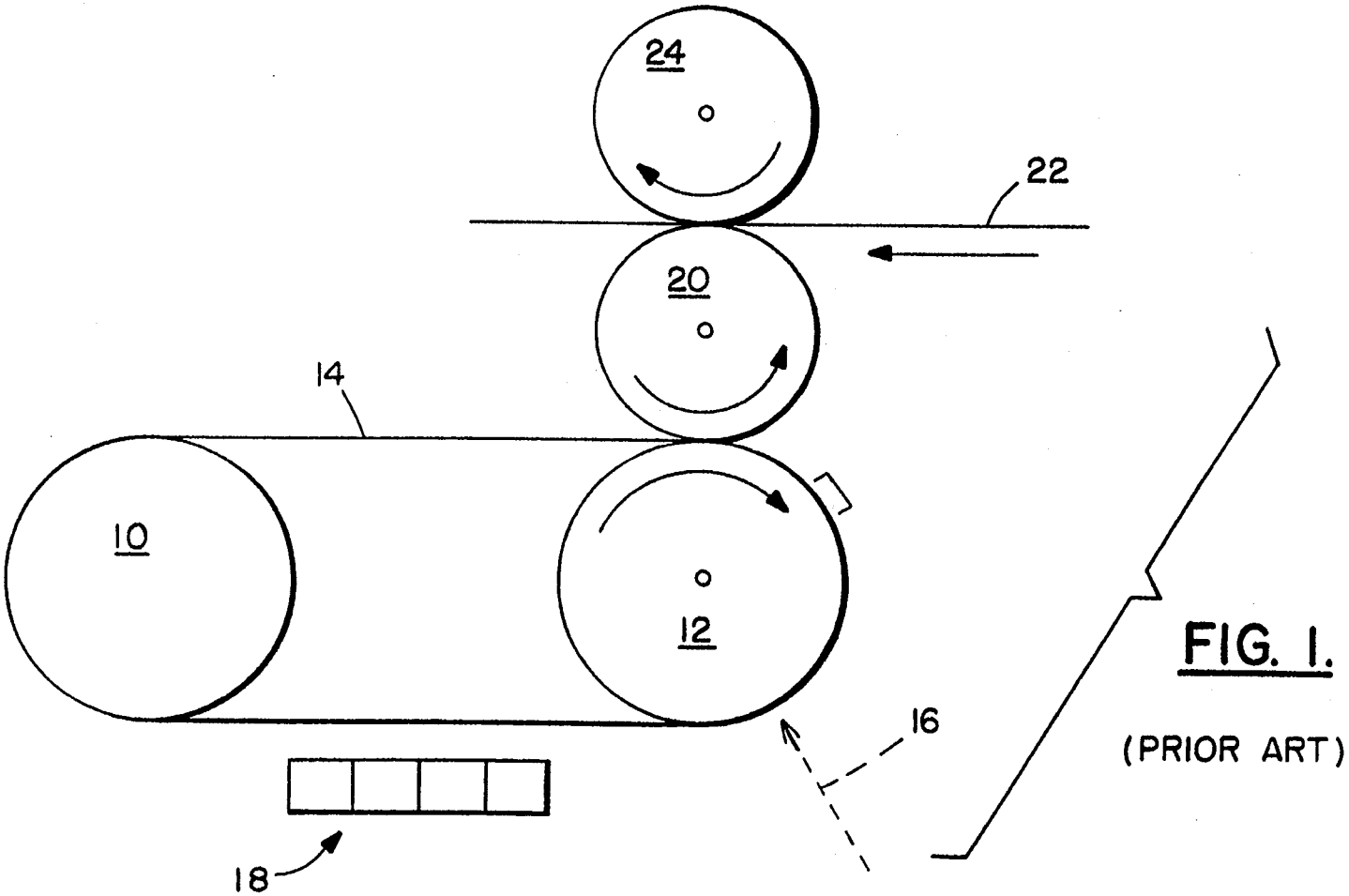
FIG. 1. (PRIOR ART)
FIG. 1 is a schematic side view of a prior art liquid electrophotography system.
Figure 2:
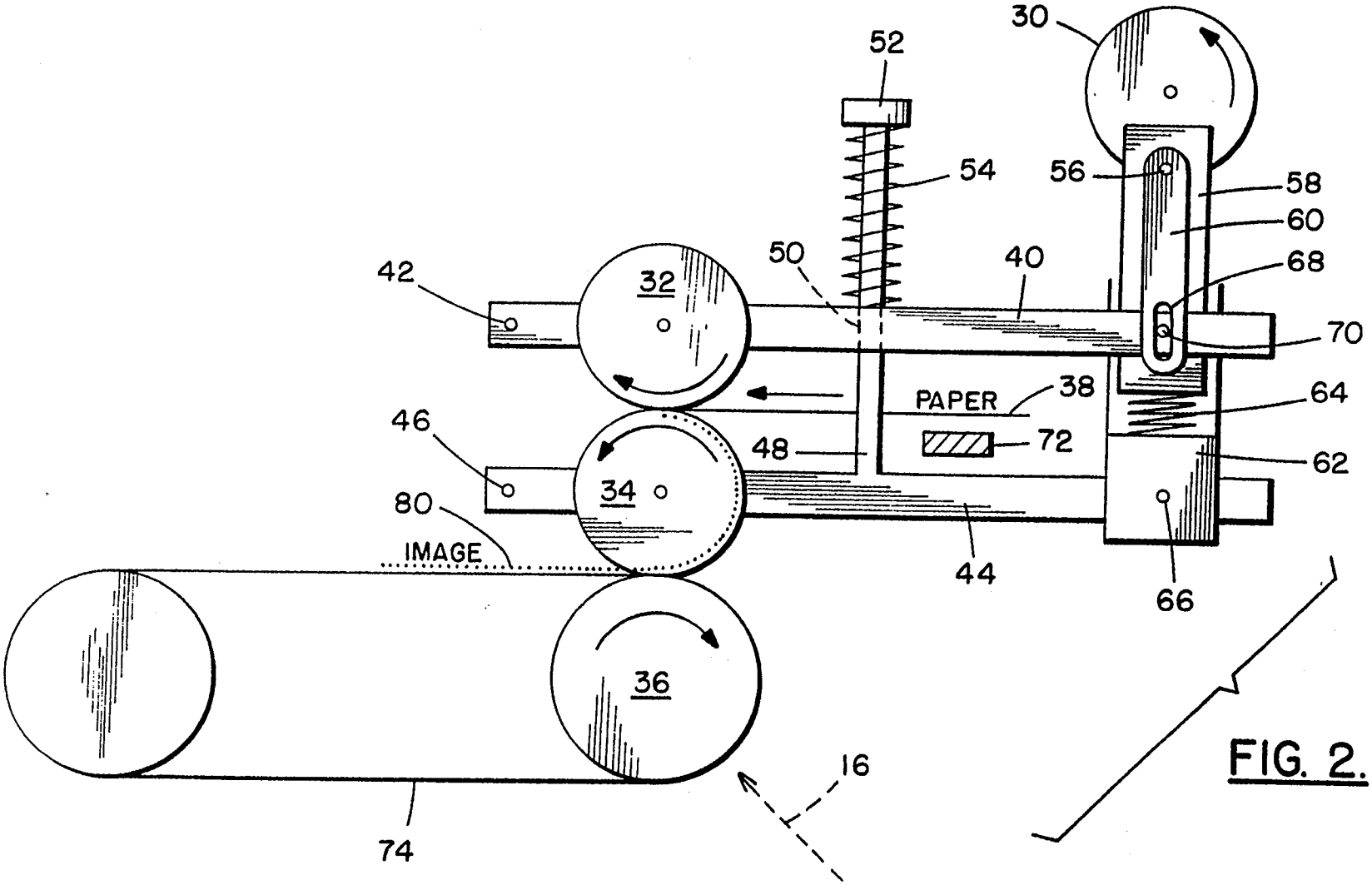
FIG. 2 is a schematic view of a roller position control mechanism that incorporates the invention hereof, with an operating crank in a position so as to maintain pressure, transfer and photoconductor rollers all in intimate contact.
Figure 3:
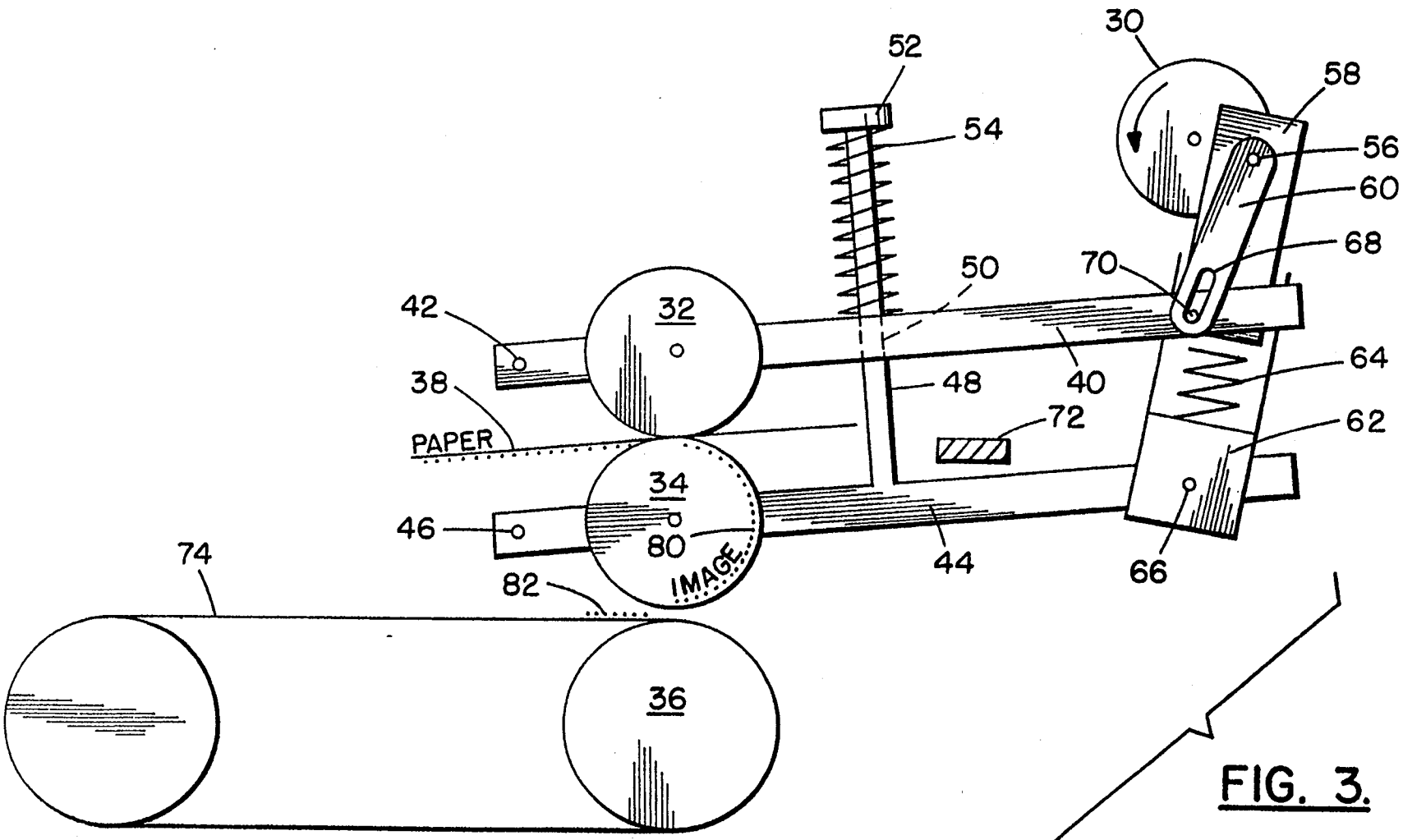
FIG. 3 is a view of the mechanism of FIG. 2 when the operating crank has rotated by approximately 90° to bring the transfer roller out of contact with the photoconductor roller, while maintaining contact between the pressure roller and transfer roller.
Figure 4:
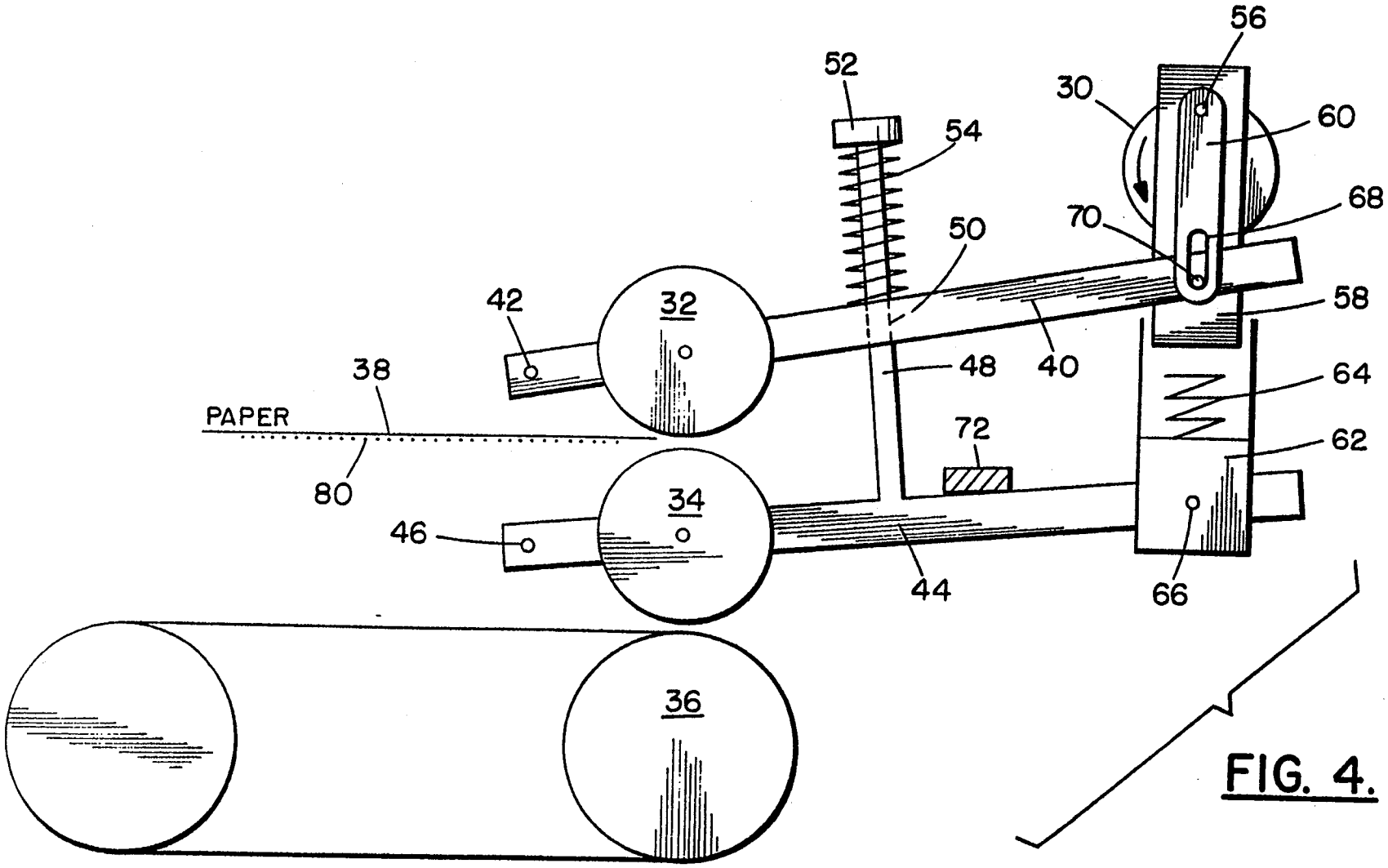
FIG. 4 is a view of the mechanism of FIG. 3 after the operating crank has proceeded through an additional 90° rotation to bring the pressure roller and transfer roller out of contact with each other.

Referring now to FIGS. 2–4, the roller control mechanism incorporating the invention will be described at three points of rotation of an operating crank 30. It is to be understood that FIGS. 2–4 are schematic views and are used to describe the basic operation of the mechanism. It is to be further understood that pressure roller 32, transfer roller 34 and photoconductor roller 36 are three dimensional elongated rollers and that the control mechanism to be hereafter described is present at both ends of the respective rollers and is actuated simultaneously by identical cranks 30 at both ends of a gear-operated shaft (not shown).

Pressure roller 32, in the known manner, maintains a sheet of paper 38 firmly pressed against transfer roller 34 as paper sheet 38 is fed therebetween. Pressure roller 32 is journaled for rotation (at both of its extremities) into opposed pressure roller struts 40. Each pressure roller strut 40 is rotatable about a pivot mounting 42. Similarly, transfer roller 34 is journaled at both of its extremities into transfer roller struts 44. Each transfer roller strut is mounted for pivotal movement at a second pivot mounting 46. A post 48 extends upwardly from transfer roller strut 44 and is slidably positioned in an opening 50 within pressure roller strut 40. A cap nut 52 is positioned at the upper terminus of post 48 and maintains a compression spring 54 in place on post 48. Compression spring 54 biases pressure roller strut 40 towards transfer roller strut 44, thereby tending to maintain pressure roller 32 in contact with transfer roller 34.

Operating crank 30 is the sole power source for operation of the mechanism shown in FIG. 2. A pin 56 extends perpendicularly from the face of operating crank 30 and supports both a compression plunger 58 and a coupling link 60. Both compression plunger 58 and coupling link 60 are journaled onto pin 56 so as to enable rotation thereabout. Compression plunger 58 interacts with a hollow anvil link 62 in which a spring 64 is positioned. Hollow anvil link 62 is journaled for rotation about a pin 66 which is fixedly mounted to transfer roller strut 44.

Coupling link 60 includes a slot 68 through which a pin 70 extends. Pin 70 is fixedly attached to pressure roller strut 40. A mechanical stop 72 is positioned between pressure roller strut 40 and transfer roller strut 44 and is instrumental in enabling a separation to occur between pressure roller 32 and transfer roller 34 during the operation of the mechanism. While the mechanism is shown in conjunction with a photoconductor roller 36 over which a photoconductor belt 74 is positioned, it is to be understood that the invention is equally operable with a photoconductor-coated drum.

The operation of the invention will now be described in conjunction with FIGS. 2–4. In FIG. 2, it is assumed that photoconductor belt 74 has been imaged by laser beam 16 and subsequently toned to include an image 80 thereupon. It is further assumed that operating crank 30 has moved pin 56 to a lower-most position so that compression plunger 58 has compressed spring 64 against anvil link 62. This action causes transfer roller strut 64 to place transfer roller 34 into pressure engagement with photoconductor belt 74. As a result, a portion of image 80 has been transferred from photoconductor belt 80 to the surface of transfer roller 34.

Because pin 56 is in its lower most position, compression spring 54 has also forced pressure strut 40 and, thus, pressure roller 32 against the surface of transfer roller 34. Under these conditions, the position of slot 68 with respect to pin 70 in pressure roller strut 40 is such that there is no active engagement therebetween. As a result, the contact pressure between pressure roller 32 and transfer roller 34 is solely determined by the force exerted by spring 54 on pressure roller strut 40. Paper sheet 38 has commenced its travel between pressure roller 32 and transfer roller 34 so as to enable a transfer of image 80 from the surface of transfer roller 34 to the paper.

In FIG. 3, it is assumed that the entirety of image 80 has now been transferred to transfer roller 34 and that the remaining toner 82 on photoconductor belt 74 is non-image toner. As a result, it is desired to bring transfer roller 34 out of contact with photoconductor belt 74 before non-image toner 82 is transferred to transfer roller 34. To accomplish this action, operating crank 30 further rotates and causes pin 56 to move in a counterclockwise direction. This causes compression plunger 58 to disengage from spring 64 and for coupling link 60 to move in a generally upward direction. As a result, the lower-most edge of slot 68 contacts pin 70 and causes pressure roller strut 40 to rotate in a counterclockwise direction about pivot mounting 42. Spring 54, bearing against cap nut 52, causes post 48 to move transfer roller strut 44 in a counterclockwise direction about pivot mounting 46. This action brings transfer roller 34 out of contact with photoconductor belt 74 and prevents transfer of non-image toner 82 thereunto. During further rotation of photoconductor belt 74, a cleaning brush (not shown) contacts belt 74 and removes non-image toner 82. Continued rotation of transfer roller 34 enables emplacement of the remainder of image 80 onto paper 38.

As shown in FIG. 4, once image 80 has been entirely transferred to paper sheet 38, it is desired to bring pressure roller 32 out of contact with transfer roller 34 so as to prevent a rise in the temperature of transfer roller 34 and any compression set in transfer roller 34. This is accomplished by causing operating crank 30 to rotate further in a counterclockwise direction and to bring pin 56 to an upper-most position. This movement causes, through interaction of slot 68 and pin 70, a further elevation of pressure strut 40 and pressure roller 32. During upward movement of pressure roller strut 40, spring 54 causes post 48 to further elevate transfer roller strut 44. However, because of the position of stop 72, transfer roller strut 44 is prevented from further elevation by stop 72. As a result, rotation of operating crank 30 and coupling link 60 (through interaction of slot 68 and pin 70) causes further elevation of pressure roller strut 40 and a compression of spring 54. This action causes pressure roller 32 to be removed from contact with transfer roller 34. Further counterclockwise rotation of operating crank 30 enables a repeat of the above described cycle.

Figure 5:
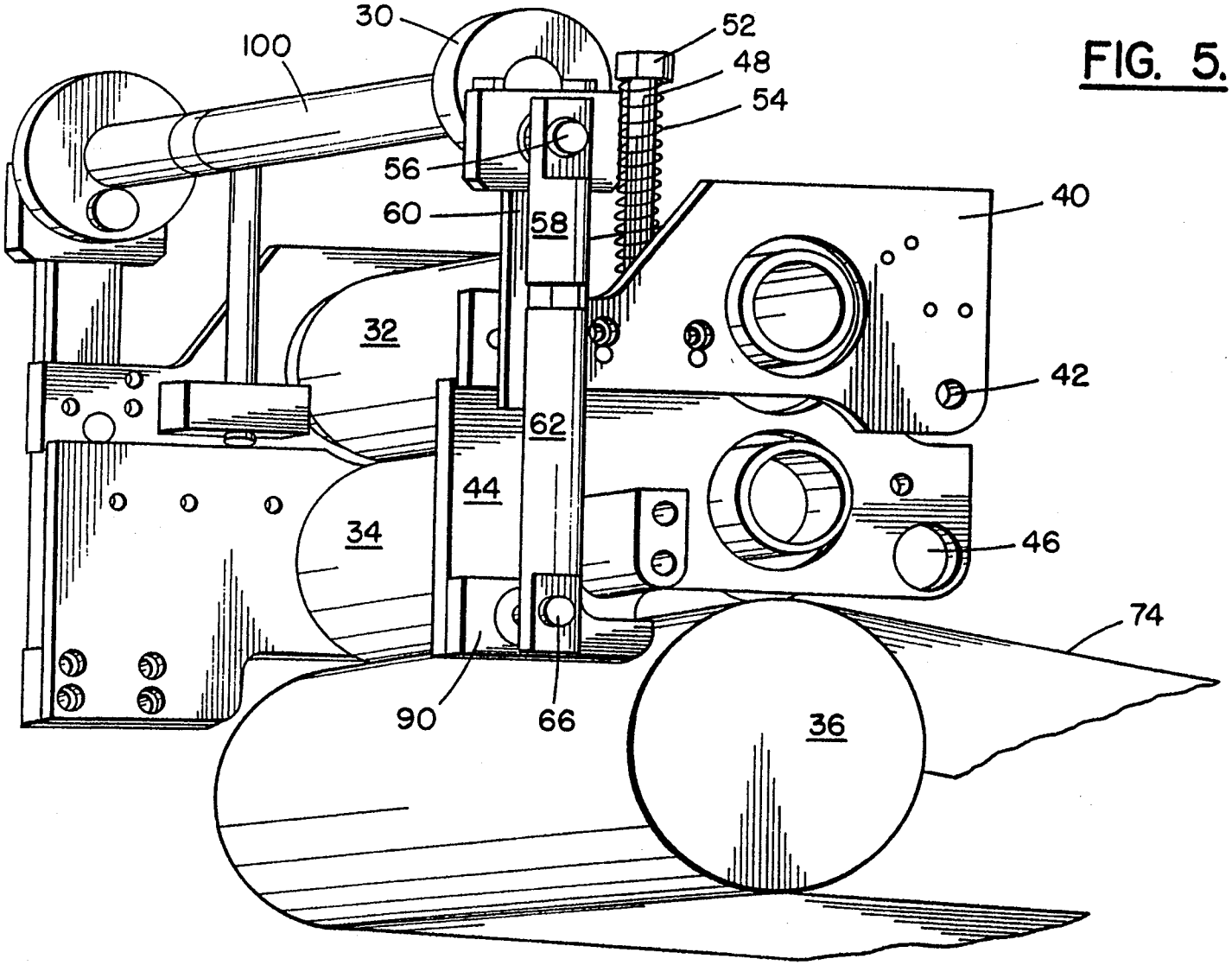
FIG. 5 is a perspective view of an implementation of the mechanism shown in FIGS. 3–4.
Figure 6:
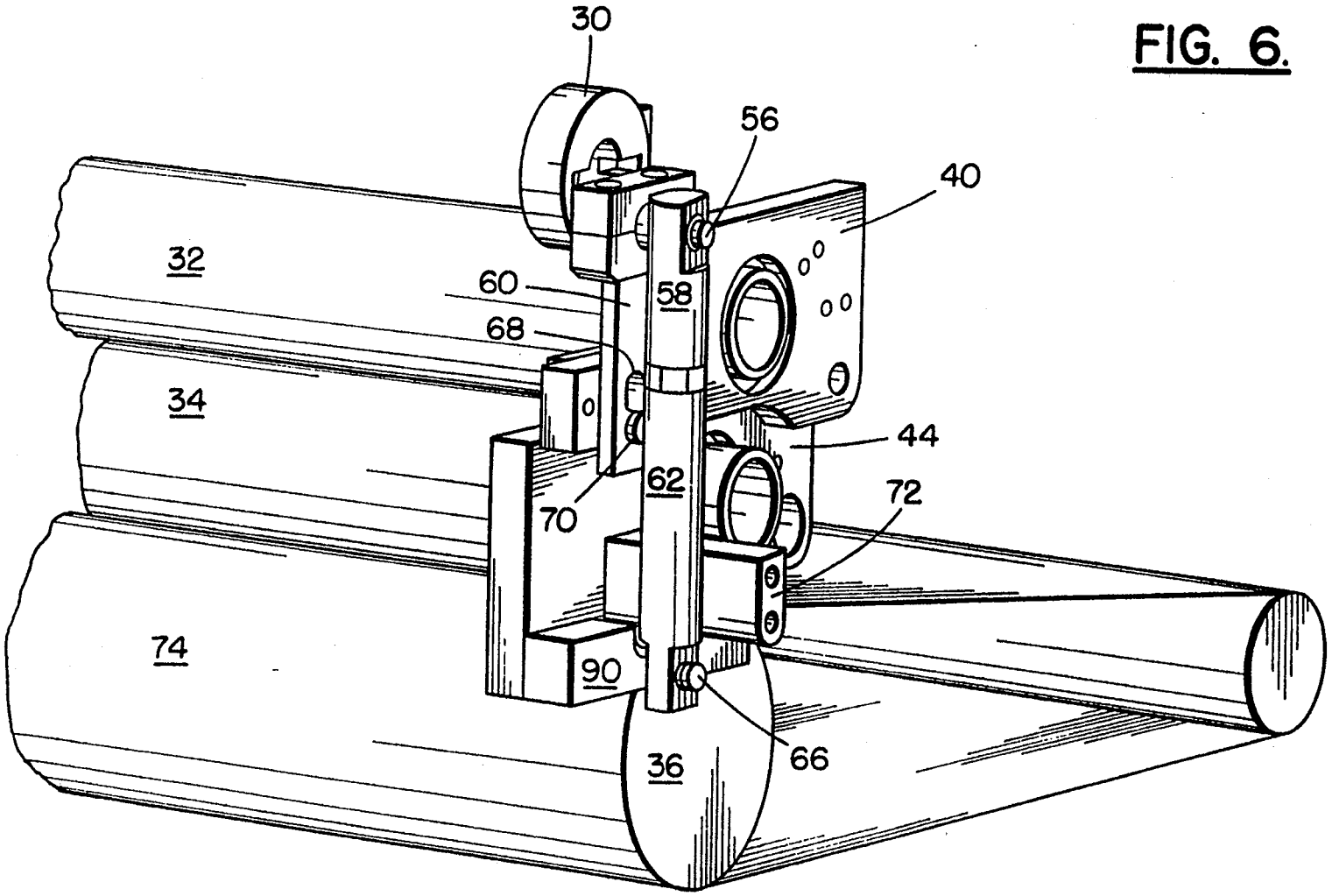
FIG. 6 is a further rotated perspective view of the mechanism of FIG. 5.

Turning to FIGS. 5 and 6, an actual embodiment of the invention is shown in two perspective views that enable a viewing of the mechanism at different angles. In FIG. 5, the entire mechanism is shown, it being understood that an identical left side (mirror image) version of the right-side mechanism resides at the other extremities of the respective rollers. The frame that supports the mechanism is not shown, nor are connecting bolts, screws, etc. which provide anchors for pivot mountings 42, 46 and attach stop 72 to a fixed strut. Stop 72 interacts with transfer roller strut 44 via an extension piece 90. A shaft which connects operating cranks 30 at either extremity of the pressure rollers is not shown to avoid over-complication of the view. Cranks 30 are operated by a single gear that engages shaft 100 (not shown). In other respects, the mechanism shown in FIGS. 5 and 6, as well as its individual components, are similarly numbered to their schematic versions shown in FIGS. 2–4 and they operate in an identical manner as above described.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An imaging apparatus for transferring toned images to sheets from a photoconductor surface, said imaging apparatus comprising:

a movable photoconductor surface;

a transfer roller positioned between transfer roller support struts;

a pressure roller positioned between pressure roller support struts;

first spring means for biasing said transfer roller against said pressure roller;

second spring means connected to said transfer roller support struts;

movable actuator means coupled to said pressure roller support struts and engageable with said second spring means, movement of said actuator means first biasing said transfer roller against said movable photoconductor surface and further movement of said actuator means enabling said first spring means to remove said transfer roller from contact with said photoconductor surface and to move said pressure roller from contact with said transfer roller.

2. The imaging apparatus as recited in claim 1 wherein said first spring means comprises:

posts extending from said transfer roller support struts; and compression springs mounted on said posts and in engagement with said pressure roller support struts so as to move said pressure roller support struts toward said transfer roller support struts and to bring said pressure roller and transfer roller into contact.

3. The imaging apparatus as recited in claim 2, further comprising:

stops positioned adjacent said transfer roller support struts for engaging said transfer roller support struts upon a movement of said actuator means, further movement of said actuator means causing said pressure roller support struts to further compress said first spring means and to bring apart said pressure roller and transfer roller.

4. The imaging apparatus as recited in claim 3 wherein said actuator means comprises a rotatable crank, a movable link that couples said rotatable crank to said pressure roller support strut and a plunger connected to said rotatable crank and positioned to be engageable with said second spring means, rotation of said rotatable crank causing an interaction between said plunger and second spring means to bring said transfer roller and movable photoconductor surface into contact and further rotation of said rotatable crank causing said movable link to bring said pressure roller support strut and, through interaction of said first spring means, said transfer roller support strut and transfer roller out of contact with said photoconductor surface.

5. The imaging apparatus as recited in claim 4 wherein still further rotation of said rotatable crank causes said movable link to further move said pressure roller support struts to further compress said first spring means, further compression of said first spring means bringing said transfer roller support struts into contact with physical stops, thereby enabling said pressure roller and transfer roller to be separated upon said further movement of said rotatable crank.

6. An imaging apparatus for transferring toned images to sheets from a photoconductor surface, said imaging apparatus comprising:

first and second pairs of pivot mounts;

plural pressure struts, each pressure strut having first and second connection points, said first connection points mounted for pivotal movement, respectively, to said pair of said first pivot mountings;

plural transfer struts, each transfer strut having first and second connection points, said first connection points mounted for pivotal movement, respectively, to said pair of said second pivot mountings;

a pressure roller axially mounted for rotation between said pressure struts, intermediate said first and second connection points;

a transfer roller axially mounted for rotation between said plural transfer struts, intermediate said first and second connection points;

photoconductor means mounted to be engageable with said transfer roller;

first spring means for biasing said pressure roller against said transfer roller;

second spring means coupled to the second connection points of said plural transfer struts;

stops positioned between adjacent ones of said pressure struts and transfer struts;

engagement control links coupled to the second connection points of said pressure struts and further engageable with said second spring means, said second spring means, when engaged by said engagement control links, biasing said transfer roller against said photoconductor means; and actuator means coupled to said engagement control links for causing said engagement control links to disengage from said second spring means and to move said plural pressure struts in a direction away from said photoconductor means, said move enabling said first spring means to move said plural transfer struts and transfer roller out of contact with said photoconductor means, further movement of said actuator means enabling said first spring means to cause said plural transfer struts to engage said stops, with further movement of said actuator means moving said plural pressure struts and enabling disengagement between said pressure roller and said transfer roller.

7. The imaging apparatus as recited in claim 6 wherein said actuator means comprises plural rotatable operating cranks that are connected to said engagement control links.

8. The imaging apparatus as recited in claim 7 wherein each engagement control link comprises a compression plunger and a coupling link, one extremity of said compression plunger and coupling link being rotatably connected to said operating crank, a second extremity of said compression plunger engaging said second spring means and a second extremity of said coupling link having a slot that engages a pin extending from said pressure strut.

9. The imaging apparatus as recited in claim 8 wherein said slot in said coupling link is designed to only interact with said pin coupled to said pressure strut to bring said pressure roller out of contact with said transfer roller.

10. The imaging apparatus as recited in claim 9 wherein said first spring means comprises a post extending from each said transfer strut and positioned to slidably engage with an adjacent pressure strut, each said post including a compression spring mounted thereon which biases said pressure strut against said transfer strut and, thus, said pressure roller against said transfer roller.

* * * * *